United States Patent [19]

Bruno et al.

[11] 4,365,966

[45] Dec. 28, 1982

[54] PROCESS FOR MODIFYING CELLULOSIC FABRICS FOR IMPROVED HEAT TRANSFER PRINTING

[75] Inventors: Joseph S. Bruno, Chalmette; Eugene J. Blanchard, New Orleans, both of La.

[73] Assignee: The United States of America as represented by the Secretary of Agriculture, Washington, D.C.

[21] Appl. No.: 302,008

[22] Filed: Sep. 15, 1981

[51] Int. Cl.[3] ..... C09B 67/00

[52] U.S. Cl. ..... 8/471; 8/552; 8/586; 8/918

[58] Field of Search ..... 8/471, 552

[56] References Cited

U.S. PATENT DOCUMENTS

| | | | |
|---|---|---|---|
| 3,078,138 | 2/1963 | Miller et al. | 8/127.5 |
| 3,079,216 | 2/1963 | Whitfield et al. | 8/127.6 |
| 3,314,909 | 4/1967 | Whitfield et al. | 260/29.6 WB |
| 3,372,978 | 3/1968 | Whitfield et al. | 8/127.6 |
| 3,406,005 | 10/1968 | Whitfield et al. | 8/115.5 |
| 3,707,346 | 12/1972 | Markert et al. | 8/471 |
| 3,829,286 | 8/1974 | Anzai et al. | 8/471 |
| 4,072,462 | 2/1978 | Vellins et al. | 8/471 |
| 4,088,440 | 5/1978 | Leimbacher et al. | 8/471 |

OTHER PUBLICATIONS

R. E. Whitfield et al., Textile Research Journal, 1966, 36, (No. 5), pp. 401–407.

*Primary Examiner*—A. Lionel Clingman
*Attorney, Agent, or Firm*—M. Howard Silverstein; David G. McConnell; Raymond C. Von Bodungen

[57] ABSTRACT

This invention relates to the transfer printing of cellulosic fabric by in situ polymerization of monomers to form polyamides and polyesters. The process involves treating the fabric with a diamine or bisphenol and then treating with a diacid chloride, drying, rinsing with neutralizing agent, and then heat transfer printing the fabric after drying. The reverse procedure can also be employed in which case the fabric is treated initially with the diacid chloride.

12 Claims, No Drawings

PROCESS FOR MODIFYING CELLULOSIC FABRICS FOR IMPROVED HEAT TRANSFER PRINTING

BACKGROUND OF THE INVENTION (1) Field of the Invention

This invention relates to heat transfer printing fabrics with dispersed dyestuffs.

(2) Description of the Prior Art

Transfer printing is conducted primarily on 100% polyester knit fabric. The process is conducive to use on poylester fabric because polyester softens in the temperature range necessary for sublimation of disperse dyestuffs. Dye classes with ionic character are not readily sublimable; therefore, their use in transfer printing is restricted.

Because of the affinity of polyester fibers for disperse dyes, cotton-polyester blend fabrics have been used for transfer printing; however, because cotton has very little affinity for disperse dyes, treatment of the fabric prior to printing is necessary to obtain adequate color brightness and depth of shade.

Several methods for polymer modification of cotton-polyester fabric for transfer printing are available, but those that are relevant consist of the application of preformed polymers to the fabric, or other surface treatments, as in British Pat. No. 1,501,889. Such surface effects generally stiffen the fabric, thereby giving it a harsh hand. In addition, the mositure absorption capacity of the fabric is severely reduced, negating the beneficial effects of the cotton component of the blend.

The unique nature of the disperse dyestuffs is that they are readily sublimable when heated at temperatures in the vicinity of 200° C. and higher. This characteristic allows the dyes to be transferred at elevated temperatures from the dye-printed paper to the desired fabric. If the fabric is composed of 100% polyester, color saturation after printing is excellent; however, if the fabric contains a substantial amount of cotton cellulose (in excess of 20%), color brightness upon printing is markedly reduced. Moreover, color saturation is further reduced upon laundering as dye is removed from the low affinity cotton component of the fabric. To improve dye affinity of the cotton component of the fabric, the fabric must be treated with a disperse dye solvent, such as glycol, or some substance that can be attached to the cellulose. Such a treatment will allow the cellulosic fiber component to have increased affinity for the disperse dye. The negative aspects of these treatments are compounded as the percentage of the cotton component increases. As the percentage of polyester is reduced, more additive has to be added to the fabric to compensate for the low affinity of cellulose for disperse dyes. In the case where preformed polymeric material is deposited on the fabric surface, the net result is a fabric with a rather harsh or stiff hand and low hydrophilic properties. In the case where high concentrations of dye solvent are employed, such as polyethylene glycol or similar agents, increased amounts of cellulosic crosslinking agent, such as dimethylol dihydroxyethyleneurea or methylolated melamine, is needed to insolubilize the glycol. This causes fabric strength properties to be reduced if too much crosslinking is used and gives the fabric durable-press properties even though they may not be desired. Furthermore, dye solvents, such as glycols can cause dye migration problems. Other processes, such as acetylation and benzoylation, are suitable for modifying cellulose to improve heat transfer printing, but these reactions do not result in the formation of polymers.

SUMMARY OF THE INVENTION

The instant invention is a process for modifying cellulosic fabric by in situ polymerization of monomers to improve the affinity of the fabric for disperse dyes during heat transfer printing. The process comprises the following steps:

(1) treating the cellulosic fabric with an aqueous solution of a diamine or bisphenol
(2) treating the fabric with a diacid chloride in an organic solvent
(3) drying the fabric;
(4) rinsing the neutralizing agent and then washing and drying;
(5) heat transfer printing with a paper containing disperse dyestuff.

The reverse procedure can also be used in which case the fabric is treated initially with a diacid chloride and then the diamine or bisphenol.

It is the object of this invention to form polyamides and polyesters in or on the fibers to allow heat transfer printing with disperse dyestuffs.

DESCRIPTION OF THE PREFERRED EMBODIMENTS

We have found that cotton and cotton-polyester fabrics can be effectively heat transfer printed by in situ formation of polyamide and polyester polymers in or on the cellulosic fibers prior to printing.

The reaction between a diamine and a diacid chloride yields a polyamide and the reaction between a bisphenol and a diacid chloride yields a polyester. Both of these polymers have affinity for disperse dyestuffs. The fabric can be further modified by treating with a methylolated crosslinking agent prior to heat transfer printing and then printed and cured simultaneously.

The specific method of this invention can be described as a process in which the fabric is impregnated initially with a 3–7% aqueous solution of a bisphenol such as 2,2-bis(4-hydroxyphenyl)propane, and phenolphthalein or diamine such as 1,6-hexamethylenediamine, propylene diamine, and polyglycoldiamine ($C_{10}H_{24}N_2O_3$).

Bisphenols have very limited water solubility and it is necessary to form a phenoxide ion by adding an inorganic base, such as sodium hydroxide, to achieve solubility. Diamines are very water soluble and do not require the addition of inorganic base for solubility. The base can be used, if desired, to neutralize the formation of HCl during the reaction. The fabric can either be dried or allowed to remain wet, so that the moisture content is from about 5 to 100%. The fabric is then treated with an inorganic solvent containing from about 3 to 7% by weight of an aromatic or aliphatic diacid chloride such as adipyl chloride, isoterephthaloyl chloride, sebacyl chloride and terephthaloyl chloride.

A mixed acid chloride can be used, such as, equal parts of isophththaloyl and terephthaloyl chloride, so that the resulting fabric hand is softer. The polyester formed from isophthaloyl chloride and bisphenol has a lower softening temperature than the one formed from terephthaloyl chloride and bisphenol. The reaction occurs instantaneously at room temperature (22°–25° C.) without any additional heat, but in some cases additional heat supplied upon drying the fabric will allow more complete reaction to occur. After the fabric is treated with the organic solvent (toluene or carbon tetrachloride) solution of acid chloride, the fabric is dried at 25° to 60° C. prior to rinsing with an organic base, such as sodium carbonate, sodium hydroxide, or other neutralizing agent.

The processing steps can be reversed, in which case the fabric is treated initially with the acid chloride solution followed by treatment with an aqueous solution of the bisphenol or diamine. Although heat is not necessary to complete the reaction, the fabric can be dried prior to neutralizing with an inorganic base if desired. Usually, the dry add-on was higher when the fabrics were dried prior to rinsing.

After treatment with acid chloride the fabric can be treated with the bisphenol or diamine by either padding with the aqueous solution or by a kiss roll treatment, in which case the fabric is not entered into the bath but contacts the solution at the interface between the two pad rolls. After the second step treatment the fabric is rinsed and neutralized with 5% sodium carbonate or sodium hydroxide followed by an acetic acid sour, if necessary, and additional rinsing with tap water. The fabric is dried prior to transfer printing.

The fabric can be further modified by treating the polymer containing fabric with cellulose cross-linking agent. Agents such as dimethylol dihydroxyethyleneurea (DMDHEU), and methylolated melamine can be used. The amount of agent can vary from about 3 to 20% by weight, but the preferred amount is from 3 to 10%. About 1.0% by weight of magnesium chloride hexahydrate metal salt catalyst is used for each 3% by weight of crosslinking agent. At this point the fabric can be transfer printed and cured simultaneously by placing transfer printing paper, containing a sublimable dye, in contact with the fabric and then applying heat at a temperature from about 190° to 225° C. for 15 to 45 seconds. The preferred conditions are 200° to 210° C. for 20 to 30 seconds. These conditions are suitable for causing transfer of dyes from the paper to the fabric and also for promoting crosslinking of the cellulose with the N-methylol derivative.

The following examples further describe the invention. They are given as illustrations and thus should not be considered as limiting the scope of the invention.

EXAMPLE 1

A 100% cotton knit fabric was treated with a solution of 6.6% polyglycoldiamine ($C_{10}H_{24}N_2O_3$), 2.4% sodium hydroxide, and 91% water. The fabric was dried at 60° C. for 10 minutes to reduce the moisture content of the fabric to 9.6%. The fabric was then treated with a solution of 6.1% terephthaloyl chloride and 93.9% toluene and then dried at 25° C. The dry add-on after washing was 4.3%. The fabric was heat transfer printed at 210° C. for 30 seconds. The initial print was very good showing that the polyamide was effective in increasing the affinity of the fabric for disperse dyestuff.

EXAMPLE 2

The 100% cotton knit fabric was treated as in Example 1 except the fabric was air dried at 25° C. to reduce the moisture content of the fabric to 32% prior to treatment with terephthaloyl chloride. The dry add-on after washing was 7.0%. The fabric was heat transfer as in Example 1 and similar results were obtained.

EXAMPLE 3

A 100% cotton fabric was treated with 3.2% isophthaloyl chloride and 3.2% terephthaloyl chloride and 93.6% toluene. The fabric was then kiss roll treated with a solution of 3.2% 2,2-bis(4-hydroxyphenyl)propane, 1.2% sodium hydroxide and 95.6% water. After drying at 25° C. and then washing to remove unreacted material, the dry add-on was 5%. Upon heat transfer printing as in Example 1, the initial print was rated very good compared to poor for the untreated printed fabric, indicating the effectiveness of a polyester formed in situ for increasing the affinity of cotton fabric for disperse dyestuff in heat transfer printing.

EXAMPLE 4

A 100% cotton fabric was treated with 6% sebacyl chloride and 94% carbon tetrachloride. The fabric was dried at 25° C. The fabric was then kiss roll padded with a solution of 6% 1,6-hexamethylenediamine and 94% water. The dry add-on after washing was 9.7%. The fabric was heat transfer printed as in Example 1 and similar results were obtained.

EXAMPLE 5

The treatments described in Example 1 and 2 were applied to a 50/50 cotton/polyester fabric to produce a fabric with very good affinity for disperse dyestuffs upon heat transfer as previously indicated in Example 1.

EXAMPLE 6

A 50/50 cotton/polyester, single knit fabric was impregnated with a formulation containing 4.8% sebacyl chloride and 95.2% toluene. The fabric was dried at 50° C. and then padded with an aqueous solution which contained 6.4% phenolphthalein, 1,6% NaOH, and 92.0% water. After drying, the fabric was treated with an aqueous solution containing 5% $Na_2CO_3$. The fabric was rinsed with water and dried for 10 minutes at 60° C. Dry add-on was 10%. The sample was transfer printed at 210° C. for 20 seconds using a transfer printing paper containing disperse dye.

EXAMPLE 7

A 50/50 cotton-polyester knit fabric was treated with 5% 2,2-bis(4-hydroxyphenyl)propane, 2% NaOH, and 90.3% water. The moisture content of the fabric was reduced to 10%. The fabric was then treated with 5.98% sebacyl chloride and 94.02% toluene. The fabric was air dried and then rinsed in tap water and soaked in 5% NaOH. After rinsing and drying the fabric had an add-on of 5.2%. It was then treated with 3% trimethylol melamine and 1% $Mgcl_2.6H_2O$. The fabric was dried at 60° C. for 7 minutes and then heat transfer printed at 200° C. For 30 seconds. The initial print was very good and the fabric had improved dimensional stability and smooth drying properties.

We claim:

1. A process for modifying cotton-containing fabric by in situ polymerization to form a polyamide for improved heat transfer printing with disperse dyestuff, said process comprising:

(a) treating the fabric with an aqueous solution of a diamine;

(b) treating the fabric with a diacid chloride in an organic solvent to form a polyamide;

(c) rinsing and drying the fabric;

(d) heat transfer printing the fabric with a paper containing disperse dyestuff.

2. The process of claim 1 wherein the aqueous solution of diamine in step (a) contains an inorganic base, such as sodium hydroxide.

3. The process of claim 1 including drying the fabric after step (b).

4. The process of claim 1 wherein the cotton-containing fabric is a 50/50 cotton/polyester material.

5. The process of claim 1 including adding a cross-linking agent selected from the group consisting of trimethylol melamine and dimethylol dihydroxyethyleneurea and a metal salt catalyst after completion of step (c).

6. The process of claim 1 wherein the diamine in (a) is selected from the group consisting of 1,6-hexamethylenediamine and polyglycoldiamine.

7. The process of claim 1 wherein the diacid chloride in (b) is selected from the group consisting of isoterephthaloyl chloride, terephthaloyl chloride, and sebacyl chloride.

8. The process of claim 1 including drying the fabric to a moisture content of about 10 to 50% after completion of step (a).

9. A process for modifying cotton-containing fabric for improved heat transfer printing with disperse dyestuff, said process comprising:

(a) treating the fabric with a diacid chloride in an organic solvent;

(b) treating the fabric with a bisphenol containing an inorganic base;

(c) rinsing the fabric with an aqueous solution and then washing and drying;

(d) heat transfer printing the fabric with a paper containing disperse dyestuff.

10. The process of claim 9 including drying the fabric after step (b).

11. The process of claim 9 wherein the fabric is treated in (b) by means of a kiss roll so that the fabric containing the diacid chloride does not come in direct contact with the pad bath containing the bisphenol.

12. The process of claim 9 wherein the bisphenol in (b) is selected from the group consisting of 2,2-bis(4-hydroxyphenyl)propane and phenolphthalein.

* * * * *